US011839347B2

(12) United States Patent
Thorne et al.

(10) Patent No.: US 11,839,347 B2
(45) Date of Patent: *Dec. 12, 2023

(54) FLEXIBLE HOSE WITH COMPACT STORAGE CONFIGURATION AND A CLEANING APPARATUS USING THE SAME

(71) Applicant: SharkNinja Operating, LLC, Needham, MA (US)

(72) Inventors: Jason B. Thorne, Dover, MA (US); Andre D. Brown, Natick, MA (US); Daniel Innes, West Roxbury, MA (US); Lee M. Cottrell, Newton, MA (US); Adam Udy, Sutton (GB); Daniel Tonderys, Needham, MA (US); David Clare, London (GB); Kai Xu, Suzhou (CN)

(73) Assignee: SharkNinja Operating LLC, Needham, MA (US)

( * ) Notice: Subject to any disclaimer, the term of this patent is extended or adjusted under 35 U.S.C. 154(b) by 169 days.

This patent is subject to a terminal disclaimer.

(21) Appl. No.: 17/240,494

(22) Filed: Apr. 26, 2021

(65) Prior Publication Data

US 2021/0244248 A1 Aug. 12, 2021

Related U.S. Application Data

(63) Continuation of application No. 16/053,260, filed on Aug. 2, 2018, now Pat. No. 10,986,970.

(Continued)

(51) Int. Cl.
*A47L 9/24* (2006.01)
*A47L 5/28* (2006.01)

(52) U.S. Cl.
CPC ..... *A47L 9/248* (2013.01); *A47L 5/28* (2013.01); *A47L 9/244* (2013.01)

(58) Field of Classification Search
CPC ..... A47L 9/248; A47L 5/28; A47L 9/244
See application file for complete search history.

(56) References Cited

U.S. PATENT DOCUMENTS 6,026,541 A 2/2000 Anderson et al.
7,156,127 B2 1/2007 Moulton et al.
(Continued)

FOREIGN PATENT DOCUMENTS

EP 1618825 A2 1/2006
EP 3301332 A1 4/2018
(Continued)

OTHER PUBLICATIONS

PCT Search Report and Written Opinion dated Nov. 19, 2018, received in corresponding PCT Application No. PCT/US18/44994, 8 pgs.

(Continued)

*Primary Examiner* — David Redding
(74) *Attorney, Agent, or Firm* — Grossman Tucker Perreault & Pfleger, PLLC

(57) ABSTRACT

A flexible hose for use with surface cleaning devices is disclosed that includes a support structure that allows a user to collapse and lock the same into a storage configuration, and then easily unlock the same using a relatively minor amount of force, e.g., a user-applied pulling force or mechanical force. Thus, in a general sense, a hose consistent with the present disclosure may include two relatively stable/steady-state configurations, namely a storage configuration and an in-use configuration. Thus, the hose allows a user to collapse and lock the hose when not in use, and to transition the hose to an in-use configuration to target various types of surfaces to clean including, for instance, floors, walls and ceilings which may be many feet (e.g., up to 5 feet or more) from the surface cleaning apparatus.

20 Claims, 11 Drawing Sheets

Related U.S. Application Data

(60) Provisional application No. 62/540,381, filed on Aug. 2, 2017.

(56) References Cited

U.S. PATENT DOCUMENTS

| | | | | |
|---|---|---|---|---|
| 10,631,696 | B1 | 4/2020 | Williamson | |
| 10,986,970 | B2 * | 4/2021 | Thorne | A47L 9/248 |
| 2007/0174991 | A1 | 8/2007 | Trotter | |
| 2008/0295276 | A1 | 12/2008 | Jeon | |
| 2009/0050227 | A1 | 2/2009 | Smith | |
| 2011/0016657 | A1 | 1/2011 | Chudleigh | |
| 2018/0014708 | A1 | 1/2018 | Tucker et al. | |

FOREIGN PATENT DOCUMENTS

| | | | |
|---|---|---|---|
| JP | H0759693 | A | 3/1995 |
| WO | 2015021762 | A1 | 2/2015 |

OTHER PUBLICATIONS

Chinese Office Action with translation dated Jun. 1, 2020, received in Chinese patent application No. 201880053338.X, 12 pgs.
EP Search Report dated Mar. 7, 2020, received in EP Application No. 18841931.1, 9 pgs.

* cited by examiner

FLEXIBLE HOSE WITH COMPACT STORAGE CONFIGURATION AND A CLEANING APPARATUS USING THE SAME

CROSS-REFERENCE TO RELATED APPLICATIONS

This application is a continuation of co-pending application Ser. No. 16/053,260 filed Aug. 2, 2018, which claims the benefit of U.S. Provisional Patent Application Ser. No. 62/540,381, filed on Aug. 2, 2017, all of which are is fully incorporated herein by reference.

TECHNICAL FIELD

The present disclosure relates to surface cleaning devices, and more particularly, to a hose for use with surface cleaning devices that includes a locking mechanism for compact storage purposes.

BACKGROUND INFORMATION

Powered devices, such as vacuum cleaners, have multiple components that each receive electrical power from one or more power sources (e.g., one or more batteries or electrical mains). For example, a vacuum cleaner may include a suction motor to generate a vacuum within a cleaning head. The generated vacuum collects debris from a surface to be cleaned and deposits the debris, for example, in a debris collector. The vacuum may also include a motor to rotate a brush roll within the cleaning head. The rotation of the brush roll agitates debris that has adhered to the surface to be cleaned such that the generated vacuum is capable of removing the debris from the surface. In addition to electrical components for cleaning, the vacuum cleaner may include one or more light sources to illuminate an area to be cleaned.

Some vacuum cleaners include a flexible hose to support features such as wand-based cleaning. Such flexible hoses often include an internal spring structure that retracts back to a compressed resting position when not being pulled by a user during use.

BRIEF DESCRIPTION OF THE DRAWINGS

These and other features and advantages will be better understood by reading the following detailed description, taken together with the drawings, wherein.

DETAILED DESCRIPTION

Figure 3:
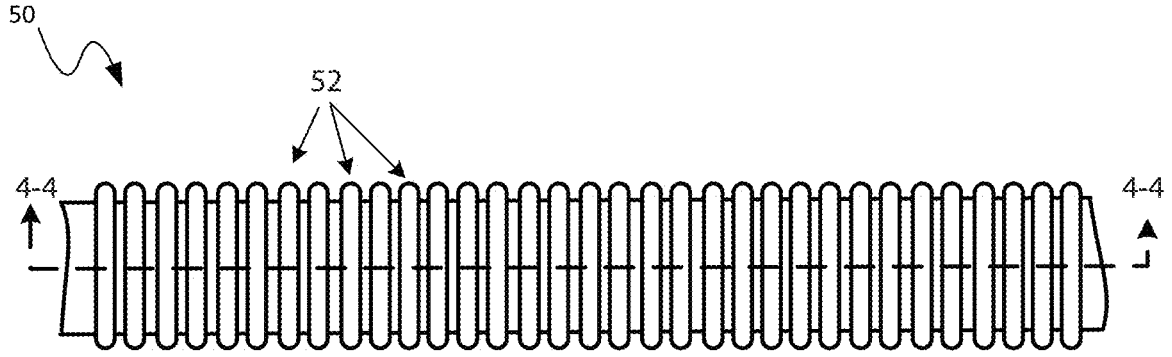
FIG. 3 shows an example hose suitable for use by the surface cleaning apparatus of FIG. 1.
Figure 4:
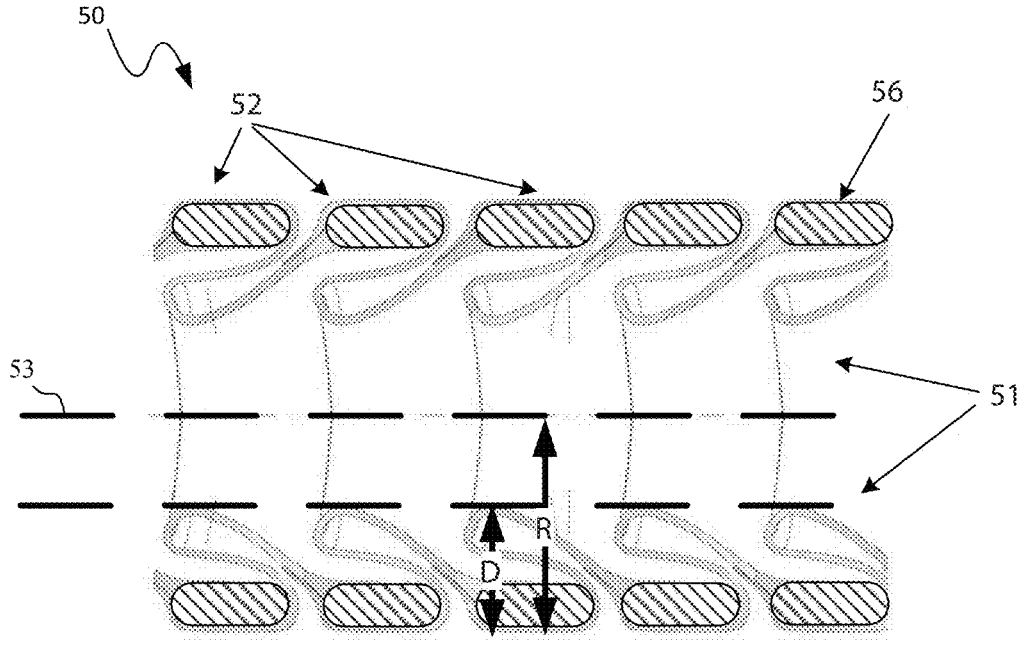
FIG. 4 shows a cross-sectional view of the hose of FIG. 3 taken along the line 4-4.

Flexible hoses generally have a limited to a stretch ratio. This may result in a relatively "loose" appearing hose when a surface cleaning device is placed in a storage configuration. For example, FIG. 3 shows a portion of a hose 50 for use in conventional surface cleaning devices. The hose 50 may include a support structure that includes a resting position whereby the hose 50 has a total overall length which is less than the overall length of the hose when the hose is stretched by a user during use. FIG. 4 shows a cross-sectional view of the hose 50 of FIG. 3 taken along the line 4-4. As shown, the hose 50 includes a plurality of rigid support members 52 that may comprise, for example, a spring or other similar structure. A layer of cover material 56 may at least partially cover/surround the support structure. To allow for the hose 50 to be used while in the resting position shown in FIG. 4, each of the collapsible sections 51 extend a distance D towards center line 53 that is about one half the radius R of the passageway extending through the hose 50. This allows for a relatively unobstructed passageway even when the hose 50 is not stretched/pulled during use. However, the relatively short overall length of each of the collapsible sections 51, i.e., to limit the distance D, unfortunately limits the maximum stretch ratio of the hose 50 to avoid blocking/obstructing the passageway of the hose 50.

Thus, in accordance with an embodiment of the present disclosure, a flexible hose for use with surface cleaning devices is disclosed that includes a support structure that allows a user to collapse and lock the same into a storage configuration, and then easily unlock the same using a relatively minor amount of force, e.g., a user-applied pulling force or mechanical force. In a general sense, a hose consistent with the present disclosure may include two relatively stable/steady-state configurations, namely a storage configuration and an in-use configuration. Thus, the hose allows a user to collapse and lock the hose when not in use, and to transition the hose to an in-use configuration to target various types of surfaces to clean including, for instance, floors, walls and ceilings which may be several feet (e.g., up to 5 feet or more) from the surface cleaning apparatus.

Accordingly, the visible portion of a hose may be reduced when in a storage configuration to increase aesthetic appeal and reduce overall footprint while still allowing the hose to have a stretch ratio that exceeds other known hose devices. Moreover, as the hose devices of the present disclosure tend towards a naturally-extended resting configuration, a relatively minor amount of user-supplied force may be necessary to manipulate the hose and reach various surfaces to be cleaned, e.g., 5 lbs of pulling force or less, and preferably less than 3 lbs of force.

Aspects and embodiments of the following disclosure may be utilized in a wide-range of applications and are not necessarily limited to vacuum cleaner devices. For example, a hose consistent with aspects of the present disclosure may be utilized in so-called "room" vacuums where an outlet is provided within a room to allow for convenient attachment of a hose to the outlet for dirt and dust collection purposes.

Figure 1:
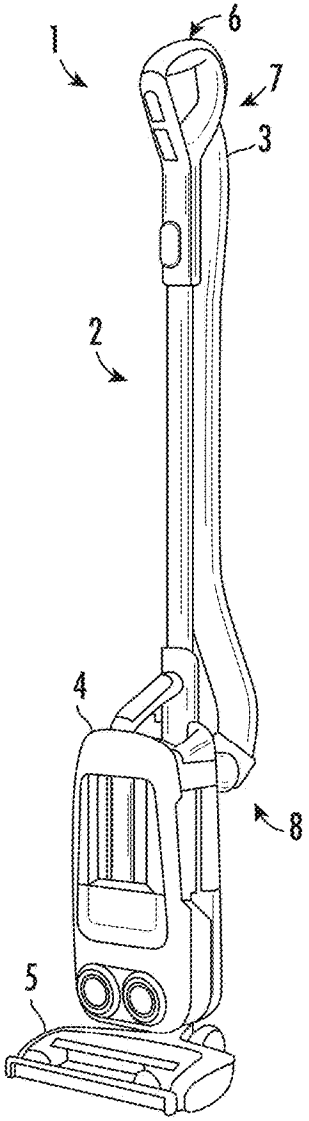
FIG. 1 shows perspective view of an example of a surface cleaning apparatus, in accordance with embodiment of the present disclosure.

Turning to the Figures, FIG. 1 show an example embodiment of a surface cleaning apparatus 1 in accordance with an embodiment of the present disclosure. As shown, the surface cleaning apparatus 1 includes a wand portion 2, a hose 3, a housing 4, and a cleaning head 5. The wand portion 2 may further include a handle 6 at an end proximal to the hose 3. The handle 6 may also be referred to as a handle portion, or simply a handle. Likewise, the housing 4 may also be referred to as an upright portion or a support structure. The cleaning head 5 may also be referred to as a nozzle. Although aspects and examples discussed herein specifically reference the surface cleaning apparatus 1 being an upright vacuum cleaner, this disclosure is equally applicable to other vacuum types, e.g., canister vacuums.

As shown, the hose 3 includes a first end 7 coupled with the wand 2, e.g., in fluid communication, to receive dirty air and a second end 8 coupled to a dirty air inlet (not shown) of the housing 4. In an embodiment of the present disclosure, the hose 3 includes a resting configuration (or in-use configuration) which includes the overall length of the hose 3 being longer than the overall length of the hose 3 in a compressed storage position.

Figure 2C:
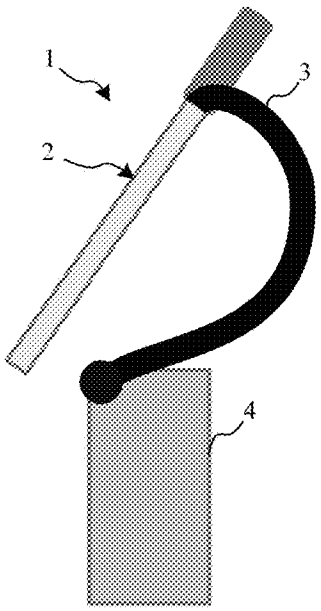
FIGS. 2A-2C show a surface cleaning apparatus in a storage configuration and various in-use configurations, in accordance with aspects of the present disclosure.
Figure 2B:
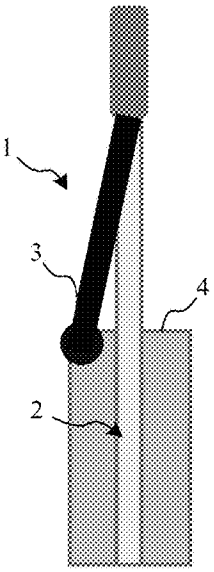
Figure 2A:
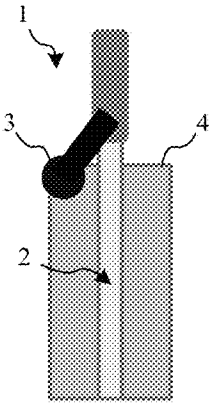

Turning to FIGS. 2A-2C, the surface cleaning apparatus 1 is shown in accordance with embodiments of the present disclosure. As shown in FIG. 2A, the surface cleaning apparatus 1 is shown in a storage configuration (or compressed storage configuration). In this embodiment, the hose 3 may include a compressed storage configuration that advantageously limits the amount of hose visible when the surface cleaning apparatus 1 is stowed in a storage location, e.g., a corner, behind a door, a closet, etc.

As shown in FIG. 2B, the surface cleaning apparatus 1 is in a upright configuration, similar to the embodiment shown in FIG. 1. In this embodiment, the hose 3 remains relatively taught/tight based on an internal support structure of the hose 3 that locks the hose 3 in an intermediate storage configuration. As used herein, intermediate storage configuration refers to the hose 3 being at least partially compressed such that the overall length of the hose in the intermediate storage configuration is greater than the overall length of the hose in the compressed storage configuration, and less than the overall length of the hose in an in-use configuration, which is shown more clearly in FIG. 2C. Note, a surface cleaning apparatus may continue to be used, i.e., collect dust and dirt, when the hose 3 is in an intermediate storage configuration. As shown in FIG. 2B, the intermediate storage configuration also reduces the amount of visible hose, similar to the embodiment of FIG. 2A discussed above.

FIG. 2C shows the surface cleaning apparatus 1 in a wand configuration, whereby the wand 2 may be decoupled from the housing 4 and used to clean surfaces without the use of a nozzle, e.g., nozzle 5. As shown in FIG. 2C, the hose 3 may "stretch" to allow a user to easily extend the wand 2 towards a target surface to be cleaned.

Figure 5A:
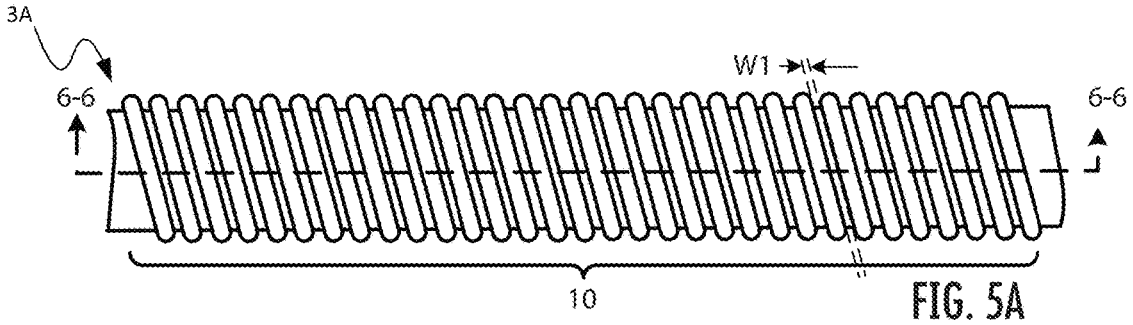
FIGS. 5A-5B show another example hose configured in accordance with aspects of the present disclosure.
Figure 5B:
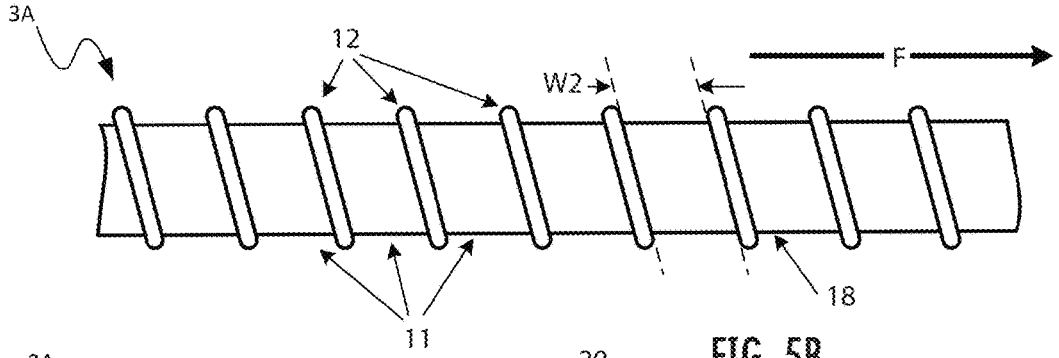
Figure 6:
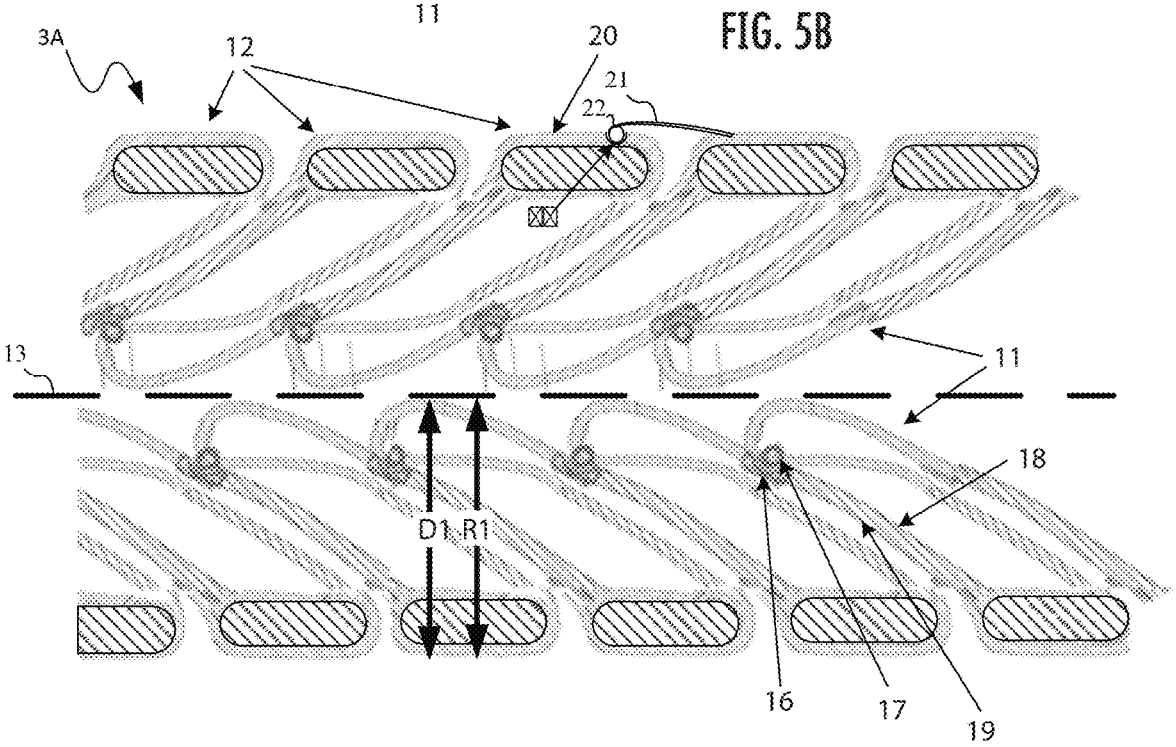
FIG. 6 is a cross-sectional view of the hose of FIG. 5A taken along the line 6-6 in accordance with an embodiment of the present disclosure.

Turning to FIGS. 5A, 5B and 6, an example hose 3A having a helical support structure 10 is shown in accordance with an embodiment of the present disclosure. The helical support structure 10 may be provided at least in part by, for example, a coil spring at least partially surrounded by a layer of cover material such as a thermoplastic or other suitably flexible material, which is shown in more detail in FIG. 6. The hose 3A may also include a support structure 10 formed and configured in accordance with embodiments discussed in U.S. Pat. No. 7,156,127 entitled "Current Carrying Stretch Hose," which is herein incorporated by reference in its entirety.

In any event, the support structure 10 may include rigid supports members 12 provided by a spring or other suitable device capable of supplying an extension and/or compression force variable with displacement, with the direction of the force depending on a given resting state. The spring may comprise, for example, metal, plastic, or any other suitably rigid material. Thus, the hose 3A may appear to have a plurality of collapsible sections 11 when viewed from a side of the hose 3A, with each collapsible section being disposed between adjacent ones of rigid support members 12. However, the plurality of collapsible sections 11 may in fact be a single, continuous section which spirals about the length of the hose 3A.

Continuing on, the support structure 10 may tend to naturally extend along direction F in a resting state based at least in part on the configuration of the spring (or other spring-line device) used within the support structure. For example, the support structure 10 of the hose 3A may extend along direction F, with direction F extending towards the end 7 of the hose 3 shown in FIG. 1.

When in this resting state, which may also be referred to as an in-use state, each of the plurality of collapsible sections 11 may be at least a partially-extended, such as shown in FIG. 5B, and may each include an extended width of W2. Although the hose 3A of FIG. 5B is shown in a fully elongated/stretched resting state (e.g., the hose is at 100% of its potential overall length), the hose 3A may not necessarily extend to 100% of its length at rest, which is to say the hose 3A may provide some additional amount of "stretch" during use.

On the other hand, and as generally shown in FIG. 5A, when the hose 3A is in a storage configuration (or compressed storage configuration), each of the collapsible sections 11 may be folded, collapsed, or otherwise displaced towards a center line 13 of a passageway extending through the hose 3, which is discussed in greater detail below with reference to FIG. 6. Thus, in the storage configuration each of the collapsible sections 11 may have a corresponding width of W1.

Turning to FIG. 6, a cross-sectional view of the hose 3A of FIG. 5A is taken along line 6-6. As shown, the hose 3A includes a support structure 10 which is defined by the plurality of rigid support members 12, with each rigid support member 12 being separated by a collapsible section 11.

As shown, each collapsible section 11 includes a flexible section/portion defined by an inner surface 18 (or first surface) and an outer surface 19 (or second surface), with the inner surface 18 being disposed proximal (adjacent) a passageway of the hose 3 and the outer surface 19 being disposed opposite the inner surface 18. As further shown, each of the collapsible sections 11 include at least a first surface feature 16 (or retaining member, or locking member) for mating with an adjacent collapsible section. For example, a surface of the each of the collapsible sections 11 may provide the surface feature 16, with the surface feature 16 being a channel to at least partially receive and couple to a second surface feature 17 of an adjacent collapsible section. In this example, the channel may extend fully, e.g., 360 degrees, or at least partially around the inner surface defining a given collapsible section of the hose 3A to allow adjacent collapsible sections to easily align and interconnect/lock.

In any event, the first and second surfaces features 16 and 17 may form a snap-fit connection to removably couple adjacent collapsible sections. The first and second surface features 16 and 17 may therefore comprise, for example, a C-clamp, magnet, or other suitable mechanism for temporary/releasable connection. The first and second surface features 16 and 17 may be integrally formed with the collapsible sections 11, e.g., formed as single, monolithic piece via extrusion, or may be formed separately and attached via an adhesive, for instance.

Continuing with FIG. 6, each of the collapsible sections 11 extend at least partially towards center line 13 of the hose 3A. In some cases, such as shown, each of the collapsible sections 11 may extend a distance D1, with distance D1 being greater than or equal to radius R1 of the hose 3A when the hose 3A is in a storage configuration. In other cases, each of the collapsible sections may extend a distance less than radius R1 of the hose 3A. For example, the distance D1 of each collapsible section may extend at least 2/R1 or greater, depending on a desired configuration.

Therefore, the distance D1 at which each of the collapsible sections extends into the passageway of the hose 3A may substantially obstruct flow of air, e.g., by at least 20% up to 99%, when the hose 3A is in a compressed storage configuration. However, a user-supplied force may be applied to pull end 7 along direction F to de-couple adjacent collapsible sections and transition the hose 3A into an in-use position. In operation, a user may experience a perceivable audible and/or tactile response similar to a zipper or sealable bag as each of the collapsible sections "snap" away from each other. In some cases, a relatively minor amount of force, e.g., about 3 lbs of force or less, may be applied to pull the end 7 of the hose and transition the hose 3A into an in-use configuration. In other cases, the hose 3A may require a relatively heavy amount of force, e.g., up to 4 lbs or more, to transition the hose into an in-use configuration. In either case, the hose 3A may become increasingly flexible and allow the hose 3A to be easily drawn towards surfaces to clean by a user as each of the collapsible sections 11 expand into their respective expanded widths W2 (or an intermediate width between W1 and W2).

Alternatively, or in addition to internal surface features, e.g., surface features 16 and 17, to couple adjacent collapsible sections, the hose 3A may include one or more external locking mechanisms/member along the length of the hose 3B. For example, as shown in FIG. 6, surface 20 of one or more rigid support members 12 may include a catch/latch 21 to couple to couple into a surface structure 60, e.g., a channel, detent, bump, or other suitable feature, of an adjacent rigid support member. In other embodiments, each of the rigid support members 12 may include a catch/latch 21 along the entire length of the hose 3A. As shown, the catch/latch 21 may include a portion 22 at a distal end, with the portion 22 being configured to be at least partially received by and removably couple to the surface structure 60. The catch/latch 21 may be biased towards an adjacent rigid support member to hold the same in a relatively fixed position.

Figure 7A:
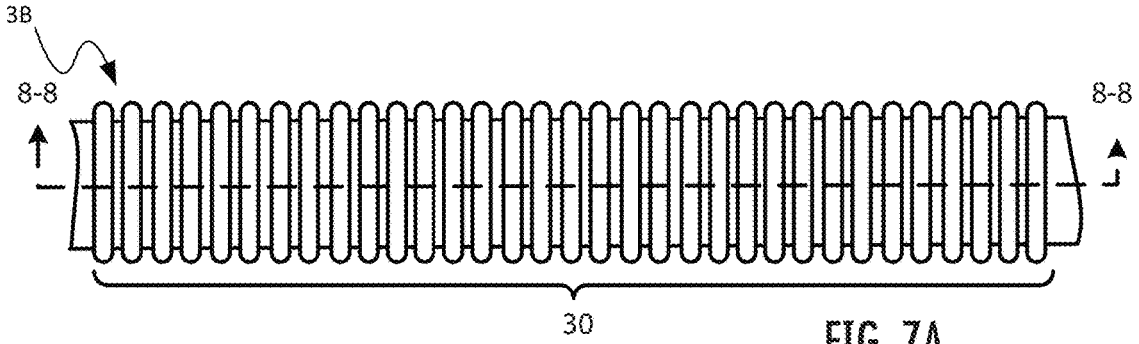
FIGS. 7A-7B show another example hose configured in accordance with aspects of the present disclosure.
Figure 7B:
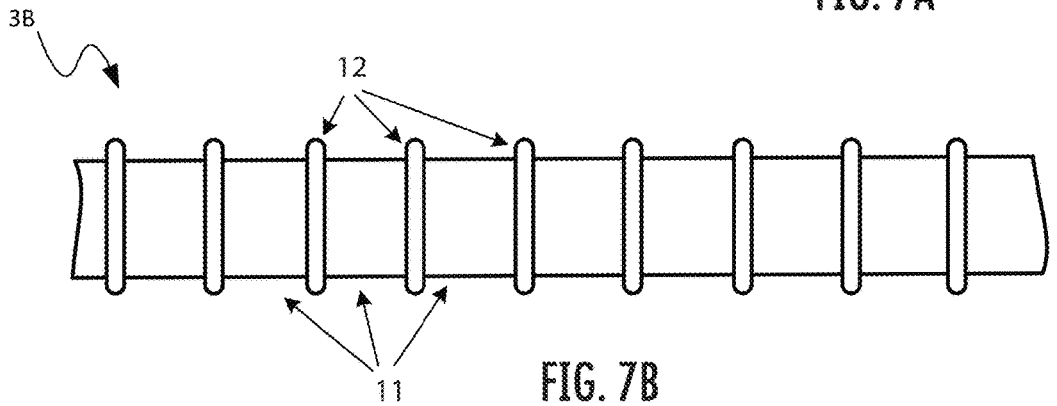
Figure 8:
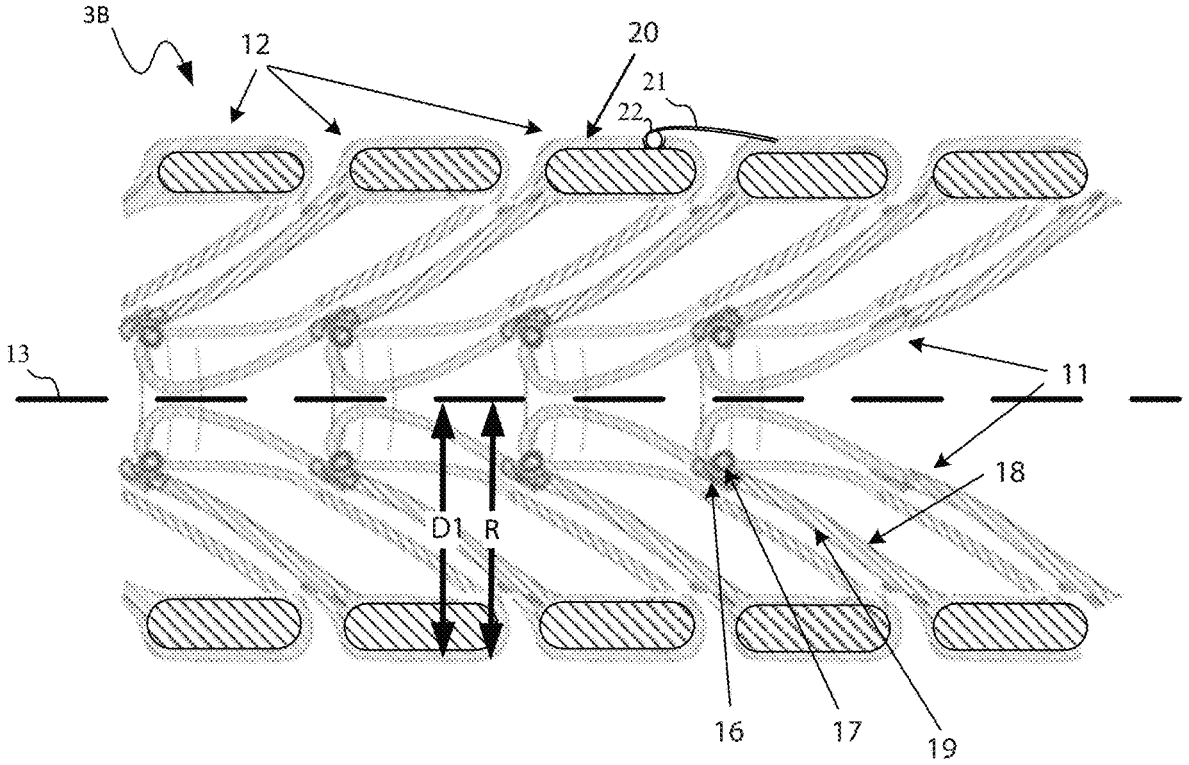
FIG. 8 is a cross-sectional view of the hose of FIG. 7A taken along the line 8-8 in accordance with an embodiment of the present disclosure.

Turning now to FIGS. 7A-7B and 8, FIG. 7A shows another example hose 3B configured in accordance with an embodiment of the present disclosure. As shown, the hose 3B includes a substantially similar configuration to that of the hose 3A, and for this reason the aspects and embodiments discussed above with regard to hose 3A are equally applicable to the embodiment shown in FIG. 7A and will not be repeated for brevity. However, the hose 3B includes a support structure 30 which comprises, for example, a plurality of concentric rings to form rigid support members 12 (as opposed to a helical support structure shown in FIG. 3A). Thus, the hose 3B may include a plurality of discrete collapsible sections separated by each of the rigid support members 12.

Figure 9:
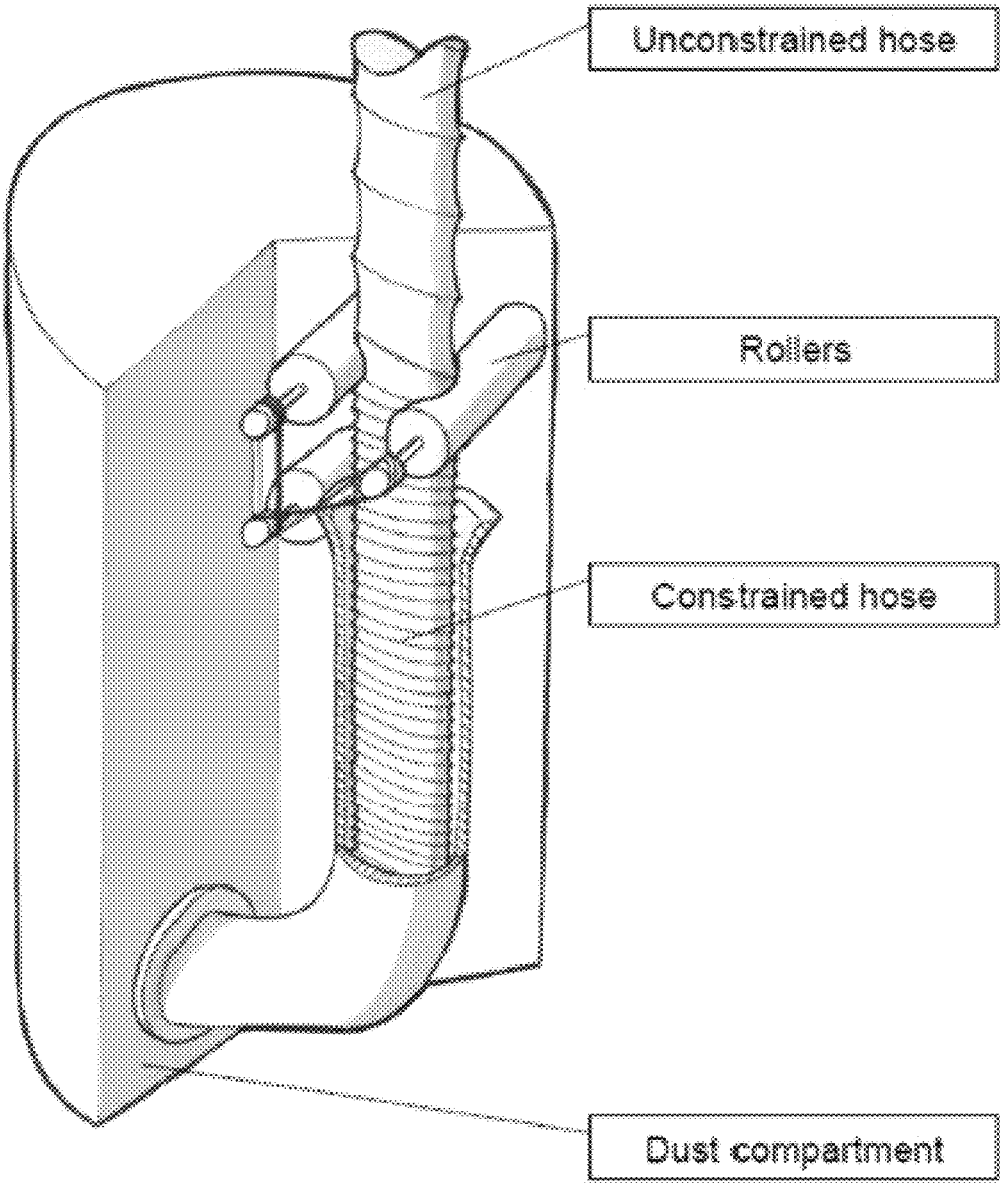
FIG. 9 shows an example body of the surface cleaning apparatus of FIG. 1 in accordance with an embodiment of the present disclosure.

FIG. 9 shows an example housing suitable for use in the surface cleaning apparatus 1 of FIG. 1. As shown, the hose includes a compression spring. At least two tension members, e.g. rollers or gears, on opposite sides of the hose apply a holding force to the hose and force the hose to collapse or extend as they rotate. Thus, the tension members may allow the hose to be controllably stretched/collapsed. In some cases, the hose will not collapse under high vacuum due to an internal support structure. In some cases, the hose may include one or more retaining members to allow for locking into a compressed storage configuration, as discussed above.

The rollers shown in FIG. 9 may provide a relatively small amount of force to provide friction against the hose. The rollers may be actuated using a motor or spring mechanism that may be energized by a user when retracting the hose, similar to the power cord of some vacuum cleaners. In both cases, the user may control the rate of the extension of the hose via a control member such as a button on the handle of the surface cleaning apparatus. In the stowed, or fully-retracted position, at least 90% of the hose may no longer be visible. In some cases, the hose may be coiled in the housing, similar to the pigtail coil shown in FIGS. 12A-12C.

Figure 10:
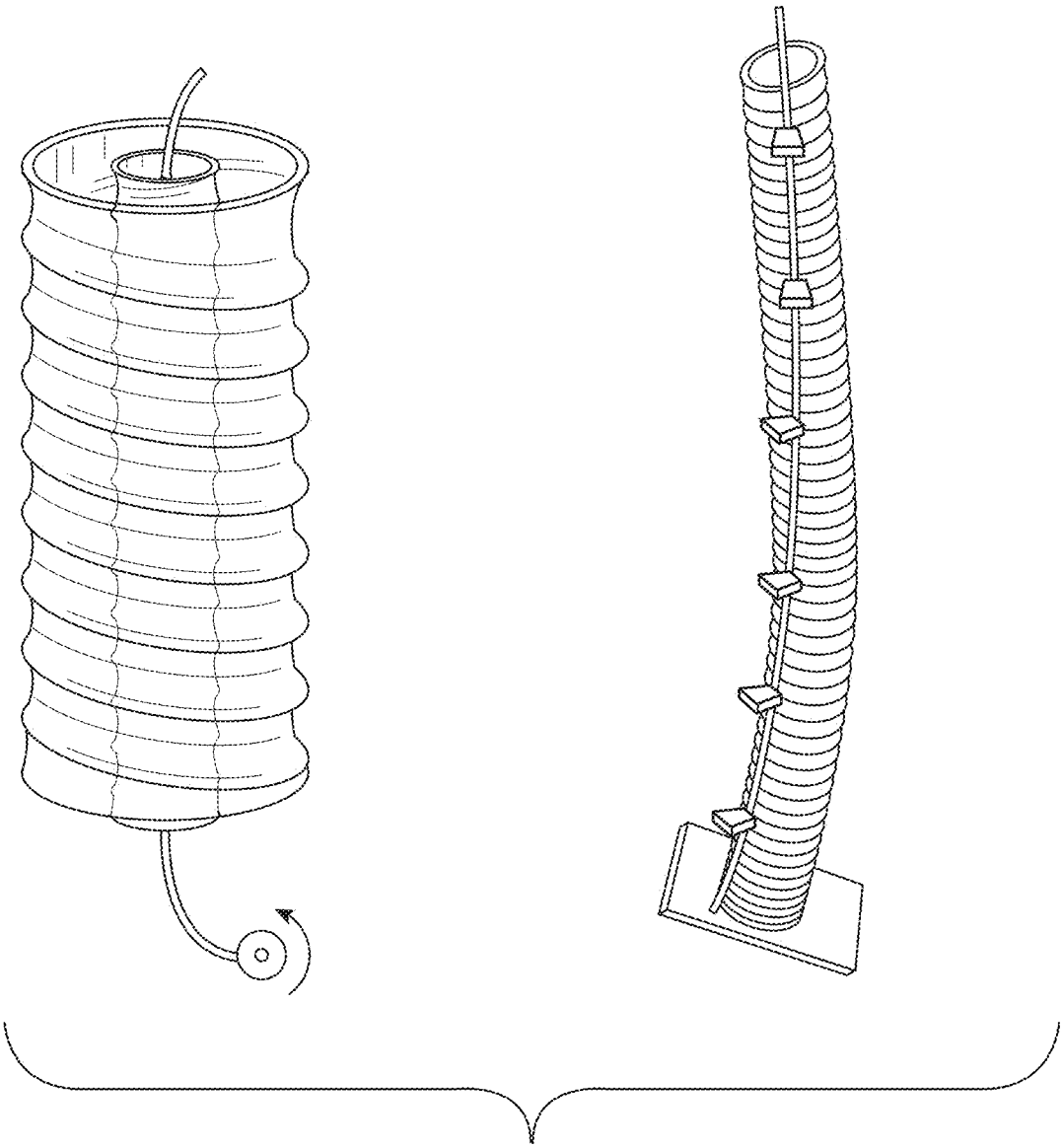
FIG. 10 shows another example hose suitable for use with the surface cleaning apparatus of FIG. 1, in accordance with an aspect of the present disclosure.

FIG. 10 shows a hose with internal and/or external retention members. The retention members may comprise a wire, for example. As each wire is retracted, the hose may proportionally collapse. The hose may include various locking features disclosed herein with reference to FIGS. 5A-8. In some cases, the housing of a surface cleaning device (or other component such as a handle/wand portion), may include a mechanical mechanism to draw the retention member (e.g., via spooling) to cause the hose to automatically retract into a compressed storage configuration.

Figure 11:
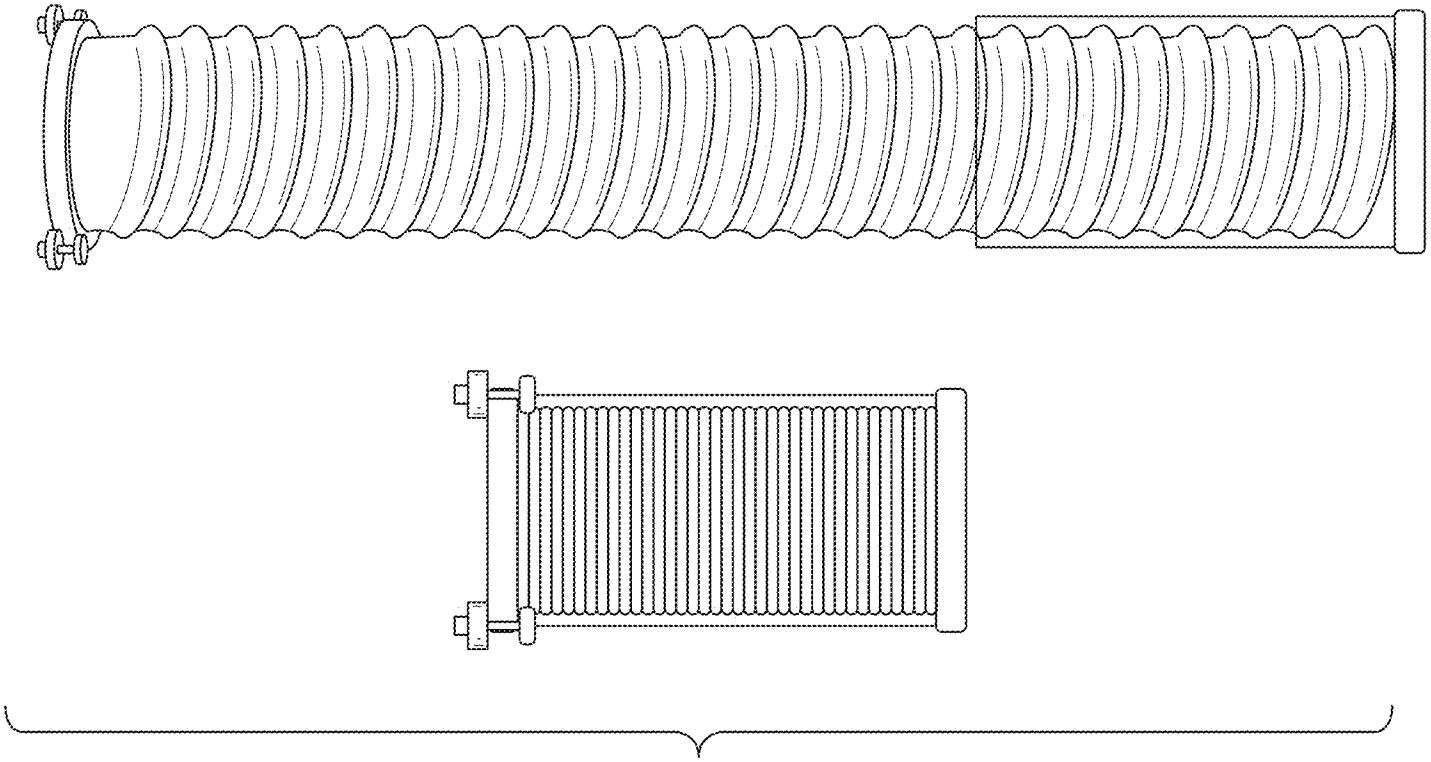
FIG. 11 shows another example hose suitable for use with the surface cleaning apparatus of FIG. 1, in accordance with an aspect of the present disclosure.

FIG. 11 shows a hose suitable for use in the surface cleaning apparatus of FIG. 1, for example. The hose has a first end proximal to a hose canister/retainer/housing and a second end disposed opposite the first end. The hose canister may include a first end to couple to the first end of the hose and a second end to removably couple to the second end of the hose. The hose may include a valve or other mechanism to seal the second end of the hose to form a vacuum within a passageway of the hose, and to provide a compressive suction force to draw the second end towards the first end of the hose to transition the hose from an in-use configuration to a compressed storage configuration. The surface cleaning apparatus 1 may automatically engage suction, e.g., via user-input, to retract the hose when transitioning to a storage configuration. A detent or other suitable mechanism, e.g., screws, latches, etc., disposed at the second end of the canister may prevent the hose 3 from extending until the user engages a button or other control feature to transition the hose to an in-use configuration. The hose of FIG. 11 may utilize the locking mechanisms variously disclosed herein with regard to FIGS. 5A-8.

Figure 12C:
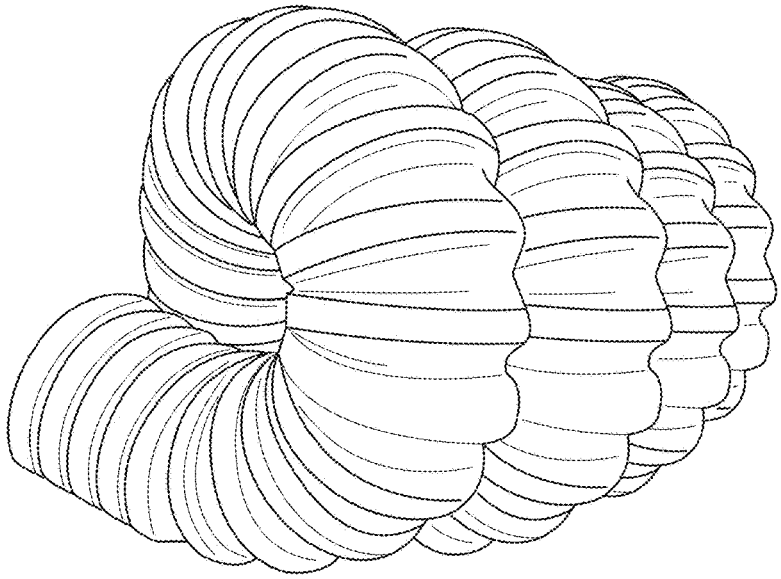
FIGS. 12A-12C collectively show another example hose suitable for use with the surface cleaning apparatus of FIG. 1, in accordance with an aspect of the present disclosure.
Figure 12B:
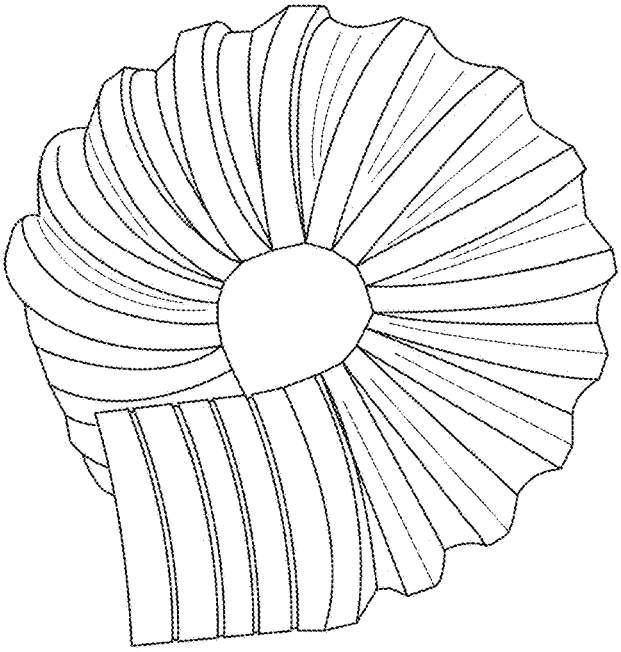
Figure 12A:
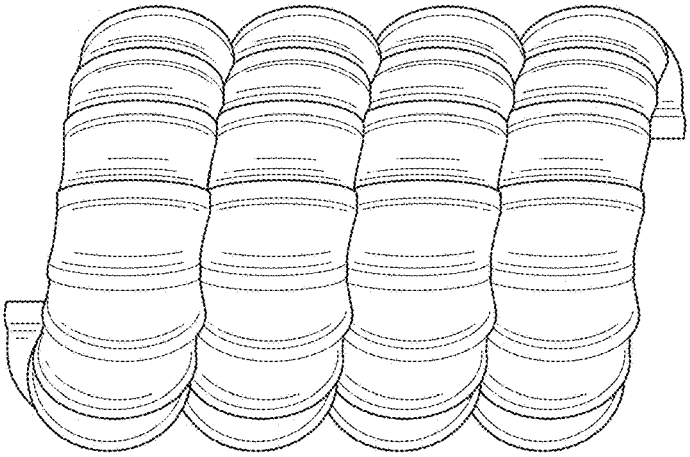

FIGS. 12A-12C collectively show a hose with a support structure allowing the hose to be stored in a pigtail configuration. A housing of a surface cleaning apparatus may store the hose in the pigtail configuration as shown based on holding a first end of the hose at a particular angle/position relative to the second end. The hose may be wound and unwound via a mechanical arrangement to transition the hose from a storage configuration to an in-use configuration.

Figure 13:
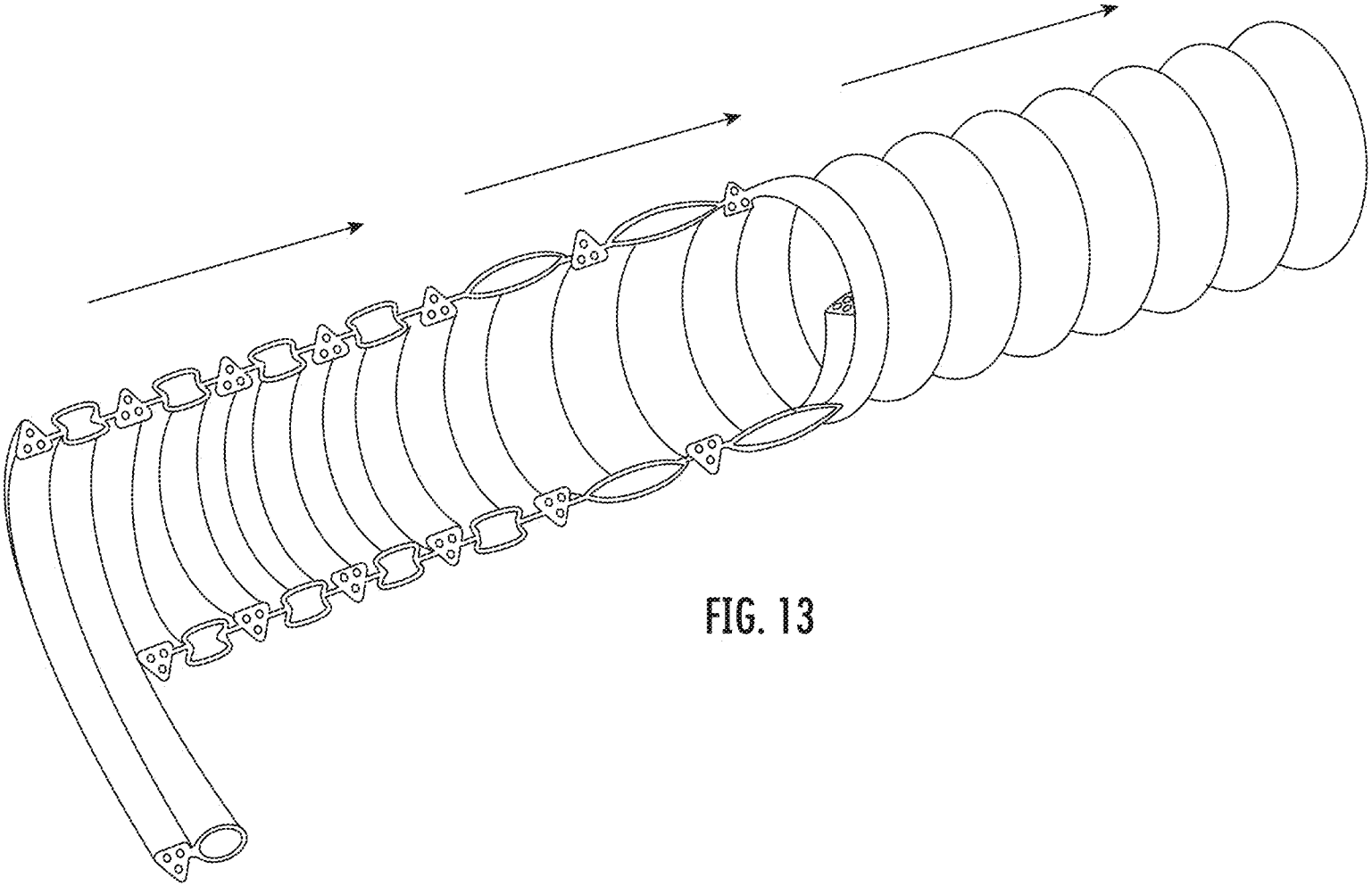
FIG. 13 shows another example hose suitable for use with the surface cleaning apparatus of FIG. 1, in accordance with an aspect of the present disclosure.

FIG. 13 shows an example hose suitable for use in the surface cleaning apparatus 1 of FIG. 1, in accordance with an embodiment of the present disclosure.

Figure 14:
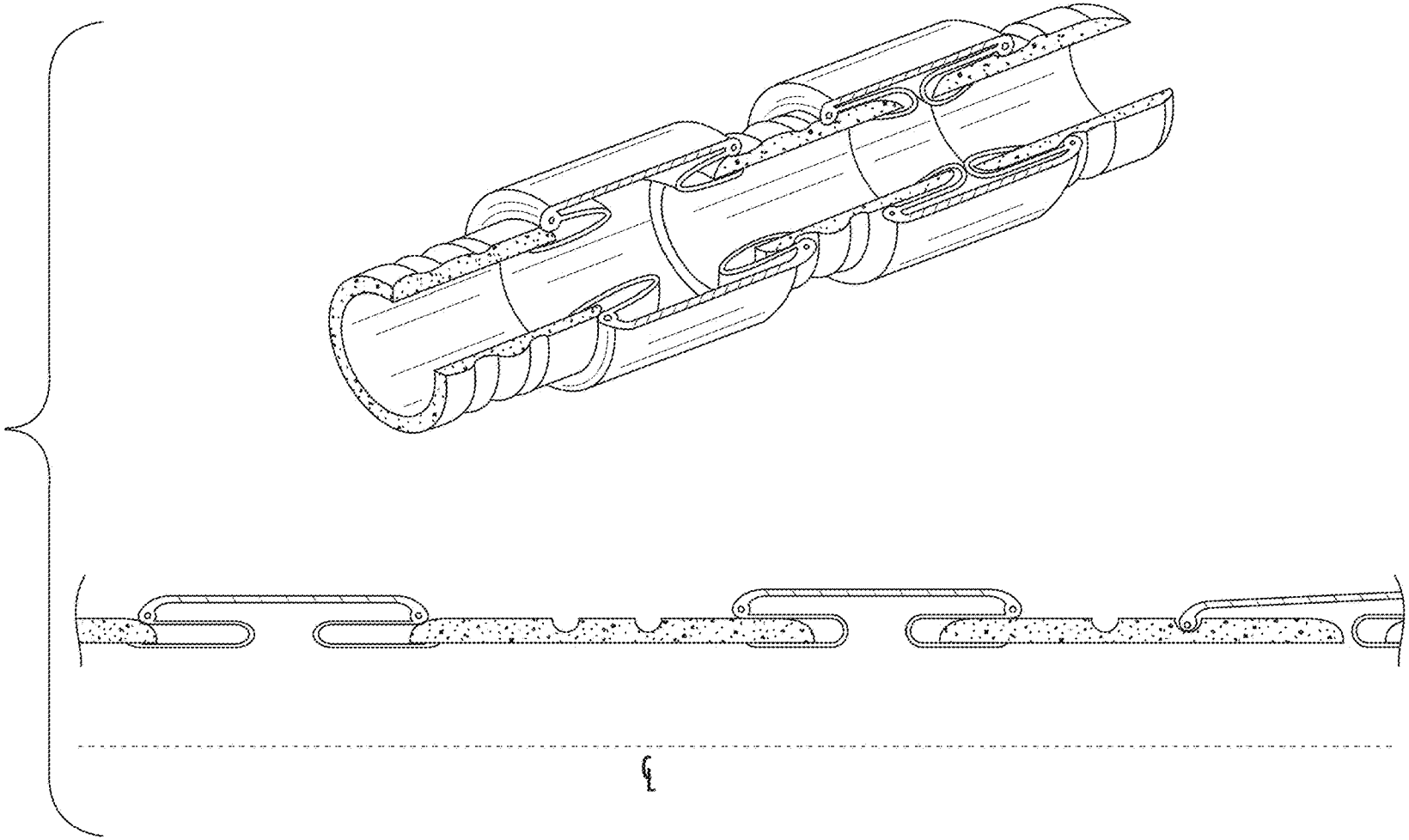
FIG. 14 shows another example hose suitable for use with the surface cleaning apparatus of FIG. 1, in accordance with an aspect of the present disclosure.

FIG. 14 shows an example hose suitable for use in the surface cleaning apparatus 1 of FIG. 1, in accordance with an embodiment of the present disclosure.

Figure 15:
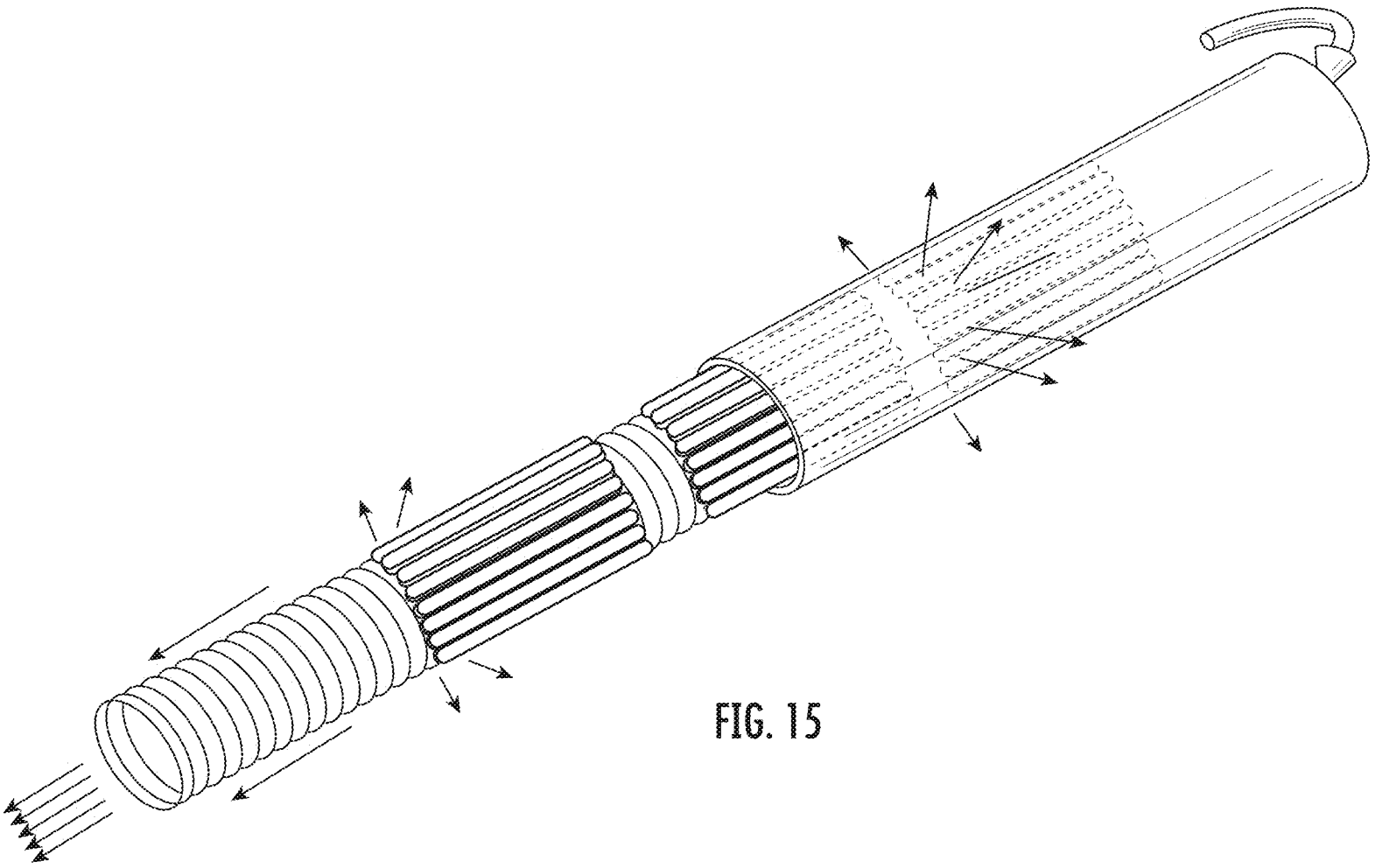
FIG. 15 shows another example hose suitable for use with the surface cleaning apparatus of FIG. 1, in accordance with an aspect of the present disclosure.

FIG. 15 shows an example hose suitable for use in the surface cleaning apparatus 1 of FIG. 1, in accordance with an embodiment of the present disclosure.

In accordance with an aspect of the present disclosure a hose for use with a surface cleaning apparatus is disclosed. The hose including a support structure extending along a length of the hose, the support structure defining a first end to couple to a dirty air inlet of the surface cleaning apparatus and a second end for receiving dirty air, and wherein the support structure is at least partially surrounded by a layer of cover material to form a plurality of collapsible sections, each collapsible section defined by a flexible portion having an interior surface proximate a passageway of the hose for receiving dirty air and an exterior surface opposite the interior surface, the passageway having a radius of R1, and wherein the support structure is compressible to transition the hose into a storage configuration to shorten the overall length of the hose, and an in-use configuration to increase the overall length of the hose, and wherein each of the plurality of collapsible sections extend a distance D1 into the passageway in the storage configuration, the distance D1 being greater than half the radius R1 of the passageway.

In accordance with another aspect of the present disclosure a surface cleaning apparatus is disclosed. The surface cleaning apparatus including a housing having a dirty air inlet, a hose with a first end to couple to the dirty air inlet and a second end for receiving dirty air, the hose including a support structure at least partially surrounded by a layer of a cover material to form a plurality of collapsible sections, each collapsible section defined by a flexible portion having an interior surface proximate a passageway of the hose and an exterior surface opposite the interior surface, and wherein the support structure is compressible to transition the hose into a storage configuration to shorten the overall length of the hose, and an in-use configuration to increase the overall length of the hose, and wherein the hose is held in the storage configuration via one or more retaining members disposed along the hose until a force is supplied to pull the first end away from the second end of the hose.

In accordance with another aspect of the present disclosure a surface cleaning apparatus is disclosed. The surface cleaning apparatus including a housing having a dirty air inlet, a flexible hose with a plurality of collapsible sections disposed between a first end and a second end of the flexible hose, the first end to couple to the dirty air inlet of the housing and the second end for receiving dirty air, the flexible hose having a first overall length in a resting configuration and a second overall length in a compressed storage configuration, the first overall length being greater than the second overall length, and means to removably couple each of the plurality of collapsible sections to each other to hold the flexible hose in the compressed configuration until a pulling force is supplied to extend the first and second ends of the hose away from each other.

While the principles of the invention have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure, which is not to be limited except by the following claims.

What is claimed is:

1. A hose for use with a surface cleaning apparatus, the hose comprising:

a helical support structure defining a passageway of the hose for receiving dirty air, the helical support structure comprising a spring at least partially surrounded by a layer of a cover material, wherein the spring extends from a first end of the hose to a second end of the hose;

wherein the support structure is compressible to transition the hose into a storage configuration to shorten the overall length of the hose, and an in-use configuration to increase the overall length of the hose; and a plurality of retainers disposed along the length of the hose for releasably locking the hose into the storage configuration.

2. The hose of claim 1, wherein the hose includes a single, continuous collapsible section which spirals along the length of the hose.

3. The hose of claim 1, wherein the plurality of retainers extend from the layer of cover material.

4. The hose of claim 3, wherein the hose includes a single, continuous collapsible section defined by the cover material.

5. The hose of claim 1, wherein the hose includes a single, continuous collapsible section which spirals along the length of the hose, wherein each of the plurality of retainers extend from the single, continuous collapsible section and are configured to mate with an adjacent retainer.

6. The hose of claim 1, wherein the hose includes a single, continuous collapsible section which spirals along the length of the hose, wherein each of the plurality of retainers extend from the single, continuous collapsible section between coils of the spring.

7. The hose of claim 1, wherein the single, continuous collapsible section extends radially towards a center of the hose when the hose is in the storage configuration, and wherein the plurality of retainers are disposed closer to the center of the hose when the hose is in the storage configuration compared to when the hose is in the in-use configuration.

8. The hose of claim 1, wherein the plurality of retainers are disposed on an interior surface of said hose.

9. The hose of claim 1, wherein the plurality of retainers are disposed on an exterior surface of said hose.

10. The hose of claim 1, wherein the plurality of retainers extend from the spring.

11. The hose surface cleaning apparatus of claim 1, wherein the plurality of retainers comprise a C-clamp, magnet device, and/or a latch.

12. A hose for use with a surface cleaning apparatus, the hose comprising:

a plurality of concentric rings;

a plurality of collapsible section disposed between adjacent pairs of the concentric rings;

wherein the hose is configured to be arranged in an in-used configuration and a storage configuration, wherein the overall length of the hose is shorter in the storage configuration compared to the in-use configuration; and a plurality of retainers disposed along the length of the hose for releasably locking the hose into the storage configuration.

13. The hose of claim 12, wherein the plurality of collapsible section includes a layer of a cover material extending along the length of the hose.

14. The hose of claim 13, wherein the plurality of retainers extend from the layer of cover material.

15. The hose of claim 13, wherein each of the plurality of retainers extend from the layer of cover material between adjacent concentric rings.

16. The hose of claim 13, wherein the plurality of continuous collapsible sections extend radially towards a center of the hose when the hose is in the storage configuration, and wherein the plurality of retainers are disposed closer to the center of the hose when the hose is in the storage configuration compared to when the hose is in the in-use configuration.

17. The hose of claim 12, wherein the plurality of retainers are disposed on an interior surface of said hose.

18. The hose of claim 12, wherein the plurality of retainers are disposed on an exterior surface of said hose.

19. The hose of claim 12, wherein the plurality of retainers extend from the plurality of concentric rings.

20. The hose surface cleaning apparatus of claim 12, wherein the plurality of retainers comprise a C-clamp, magnet device, and/or a latch.

* * * * *